United States Patent [19]

Ewald

[11] Patent Number: 4,480,754

[45] Date of Patent: Nov. 6, 1984

[54] SCREENING APPARATUS FOR GRAINS, SEEDS OR THE LIKE CROPS

[75] Inventor: Ole Ewald, Odense, Denmark

[73] Assignee: DAMAS Maskinfabrik A/S, Faaborg, Denmark

[21] Appl. No.: 447,767

[22] Filed: Dec. 8, 1982

[30] Foreign Application Priority Data

Dec. 14, 1981 [DK] Denmark ..... 5543/81

[51] Int. Cl.[3] ..... B07B 1/26

[52] U.S. Cl. ..... 209/683; 209/303

[58] Field of Search ..... 209/680, 683, 659, 303, 209/304; 494/84, 36; 366/219, 220, 234; 210/510

[56] References Cited

U.S. PATENT DOCUMENTS

| | | | |
|---|---|---|---|
| 620,860 | 3/1899 | Warrington | 209/304 |
| 2,822,127 | 2/1958 | Sinn | 209/304 X |
| 2,880,734 | 4/1959 | Edstrom | 209/303 X |
| 3,767,047 | 10/1973 | Rasmussen | 209/303 X |

FOREIGN PATENT DOCUMENTS

| | | | |
|---|---|---|---|
| 122791 | 10/1970 | Denmark . | |
| 2150799 | 4/1972 | Fed. Rep. of Germany | 209/303 |

*Primary Examiner*—David A. Scherbel
*Assistant Examiner*—Glenn B. Foster
*Attorney, Agent, or Firm*—Watson, Cole, Grindle & Watson

[57] ABSTRACT

A screening apparatus for grains comprises a housing, wherein a support structure is arranged which is rotatable by means of a main shaft. The support carries a screen drum rotatably mounted upon a planet shaft arranged eccentrically with respect to the main shaft. The support, furthermore, carries vanes engaging a delivery channel for the screened goods. In order to achieve a comparatively small resulting centrifugal force effect upon the material fed to the screen drum, while maintaining optimal peripheral speeds as regards the delivery vanes and the speed of the screen drum, the screen drum is arranged with an eccentricity with respect to the main shaft which is smaller that the greatest radius of the screen drum.

10 Claims, 1 Drawing Figure

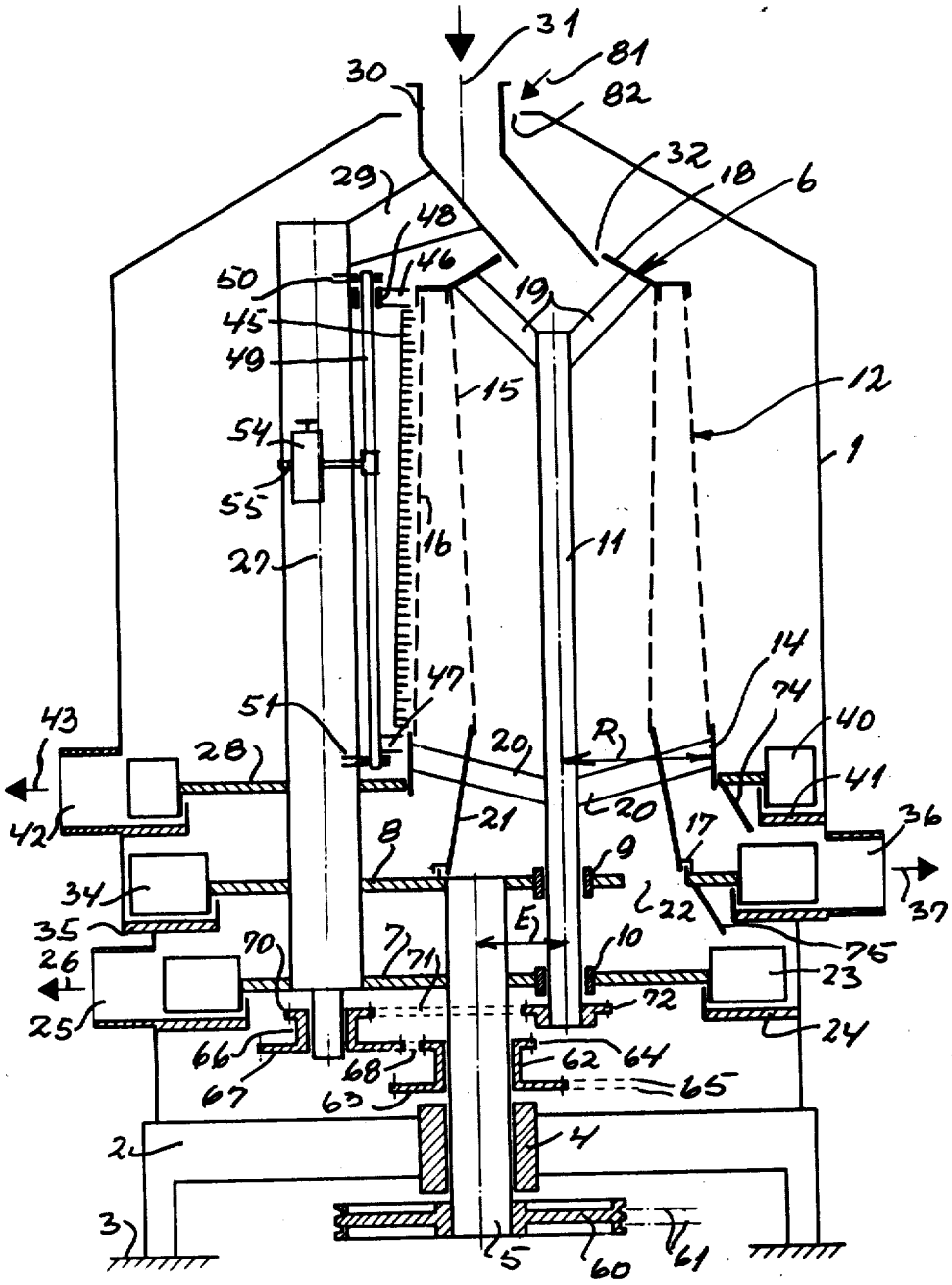
31
81
82
30
32
18
6
29
48
46
50
19
45
49
15
12
54
1
55
16
11
27
14
47
74
51
40
43
20
R
28
41
20
21
17
36
42
8
9
34
22
37
35
E
26
70
7
71
10
75
23
25
72
24
66
62
64
68
65
67
63
2
4
3
5
60
61

SCREENING APPARATUS FOR GRAINS, SEEDS OR THE LIKE CROPS

BACKGROUND OF THE INVENTION

The present invention relates to a screening apparatus for grains, seeds or the like crops comprising a housing wherein a support structure is arranged, which is adapted to be rotated about a main axis and to support screening means adapted to be rotated about a planetary axis eccentrically arranged with respect to the main axis, the support being provided with vane means which during the rotation of the support structure move in a delivery channel for the screened goods, formed in the housing.

An apparatus as referred to above is known from Danish patent specification No. 122,791. The screening means of this known apparatus consist of two screen drums, arranged diametrically with respect to the main axis and, accordingly, the planetary axes of the drum screens have an eccentricity with respect to the main axis which is greater than the longest radius of the screen drums, because the screen drums otherwise would interfere with each other. Moreover, such arrangement of screen drums is characteristic for the previously known screening apparatuses of the kind referred to above.

During the operation of such screening apparatus, the support structure and, accordingly, also the screen drums are driven in a planetary movement about the main axis and, simultaneously, each of the screen drums performs a rotating movement about its own axis which, accordingly, constitutes a planetary axis. Accordingly, the material which is fed into the screen drums will be subjected to a centrifugal force which results in that a body of material, having a cross section shape generally corresponding to a kidney, will adjust itself along the parts of the screen drums which, at any time, face outward and such body of material will move comparatively slowly down through the corresponding drum, and, simultaneously, the material which constitutes the body will be tumbled around upon the inner surfaces of the screen means whereby the screening effect wanted is achieved.

In order that the vane means which move in the delivery channel for the screened goods may conduct their dispensing effect satisfactorily, the vane means have to keep a certain peripheral speed and, simultaneously, have to be positioned at a certain distance from the main axis. Moreover, in order to achieve a reasonable good screening effect, the screening means must keep a peripheral speed which lies within comparatively narrow limits. If the peripheral speed of the screening means is too high, the material to be screened through the apertures of the screening means has a liability to "jump" over the apertures and, in case the peripheral speed of the screen means becomes very high, the bodies of material may have a tendency to move together with the screen means instead of being tumbled around on the screen means. However, on the other hand, if the peripheral speed of the screen means is too low, the screening effect will be drastically reduced and the material gets a liability to pass down through the drums at a speed which is too high to allow the material to be screened, really to be screened through the screen means.

Provided the operation conditions explained above are observed, the bodies of material will achieve a kidney shaped cross section as explained above which, however, is comparatively short as seen in the circumference direction of the screen means but which, on the other hand, has a comparatively large thickness in the radial direction. Said in other words, the kidney shape becomes short and chubby. However, this means that only a comparatively small part of the screen means will be active at any time because it will be understood that the screening effect will only be effected along the outer surface of the kidney shape which, as explained above, is comparatively narrow.

It is the object of the present invention to provide a screening apparatus as defined above wherein it is possible to keep the optimum speeds both as regards the vane means and as regards the screen means and wherein a comparatively broad kidney shape, having a comparatively small thickness in the radial direction, simultaneously, is formed whereby the active part of the screening means will be increased.

SUMMARY OF THE INVENTION

According to the invention, the eccentricity of the planetary axis with respect to the main axis is smaller than the longest radius of the screening means. By means of this construction it is achieved that the action of the centrifugal force upon the material which passes the screening means will be reduced due to the comparatively short radius of the planetary movement and the correspondingly reduced centrifugal force producing action and, simultaneously, the speed of the vane means may be kept, which also applies as regards the peripheral speed of the screening means, which offers the optimum screening action. Moreover the reduced centrifugal force action upon the material to be screened will result in that such material will tend to spread and a smaller layer thickness is achieved whereby an increased part of the surface of the screening means may be utilized.

Due to the fact that the screening means will intersect the main axis, the screening apparatus may contain a single screen drum only, and in order to balance such excentrically arranged screen drum a counterweight may according to an embodiment of the invention be arranged diametrically with respect to the screen drum in the support structure.

According to a particularly avantageous embodiment the counterweight may consist of a rod arranged parallel with the planetary axis.

In connection with the screening apparatuses of the kind here concerned, it is well known to arrange pivotably mounted brush means subjected to the effect of the centrifugal force for engaging the outer surface of the screening means which at any time are positioned innermost. The use of such brush means in connection with screening apparatuses of the kind previously known, does not cause any difficulties because the screen drums are arranged with their planetary axes at such long distance from the main axis and have diameters so short that the brush means may be pressed towards the outer surface of the drums directly due to the action of the centrifugal force upon the brush means which are arranged at the same side of the main axis as the corresponding planetary axis. The same technique cannot be used in connection with screening apparatuses according to the present invention because the part of the outer surface of the screen drum to be brushed intersects with the main axis and, accordingly, the brush means will be forced in direction away from the drum by the centrifugal force. In order to solve this problem it is according to the present invention proposed that the brush means comprise at least one weight arranged excentrically with respect to the pivot axis of the brush means. By means of such embodiment it is achieved that the weight will be forced in direction away from the drum by means of the centrifugal force and, accordingly, the weight will pivot the brush means into engagement with the outer surface of the drum.

BRIEF DESCRIPTION OF THE DRAWING

In the drawing, the sole FIGURE is a cross-sectional view of screening apparatus according to the present invention.

DESCRIPTION OF THE PREFERRED EMBODIMENT

On the drawing 1 is a housing which via a bottom frame 2 rests upon a base 3. The bottom frame 2 supports a main bearing 4 for a main shaft 5. The main bearing 4 is indicated schematically and this also applies as regards the bearings referred to in the following but it will be understood that the main bearing 4 simultaneously serves as a thrust bearing for the main shaft 5.

The main shaft 5 supports a support structure which, in general, is provided with the reference numeral 6. The supporting structure comprises a bottom 7 and an intermediate bottom 8 which are supported directly by the main shaft. In the bottom 7 and in the intermediate bottom 8, two bearings 9 and 10 are arranged wherein a planet shaft 11 is mounted. Also the planet shaft 11 is supported axially by means of the bearing structure 9, 10. The planet shaft 11 supports screening means in the form of a screen drum 12 having an inner screen 15 tapering conically downwardly and an outer screen 16 which tapers conically upwardly. The screen drum 12 constituted by the two screens 15 and 16 is supported by means of an upper upwardly tapering truncated wall 18 supported with respect to the planet shaft 11 by means of arms 19. At the lower end the drum is supported by arms 20. At their outer ends the arms 20 support a cylindrical baffle 14 which is connected with the lower end of the outer screen 16. Moreover, the arms 20 support a truncated baffle 21 to which the lower end of the inner screen 15 is connected. At the lower end the baffle 21 has a circumferentially extending groove 17 for providing a labyrinth packing with respect to the intermediate bottom 8. In the latter and within the baffle 21, an opening 22 is formed through which the material which is unable to pass through the apertures in the inner screen 15 flow downwardly and outwardly so as to be caught by vane means 23 which, when the apparatus operates, run in a channel 24 arranged in the housing 1 in such a way that such coarse material may be thrown out through an outlet 25 in the direction of the arrow 26 which, however, should be understood as extending generally tangentially with respect to the outer surface of the housing 1.

The supporting structure also supports a rod 27 acting as a counterweight which is secured to the bottom 7, to the intermediate bottom 8 and to a cover disc 28.

At the upper end the rod 27 supports a bracket 29 serving to support an inlet tube 30. The upper part of the tube 30 extends coaxially with the axis 31 of the main shaft 5 whereas the lower end of the inlet tube 30 is obliquely arranged so that the lower end may engage a hole 32 which the truncated wall 18 forms.

Along its circumference the intermediate bottom 8 has vane means 34 for dispensing the screened goods. The vane means move during the operation of the apparatus in a dispensing duct 35 in such a way that the screened goods will be thrown through an outlet 36 in the direction of the arrow 37 which, as will be understood, also is to be regarded as extending generally tangentially with respect to the housing. Also the cover disc 28 carries along its circumference vane means 40 which extend into a dispensing channel 41 from which also an outlet 42 extends in such a way that the fine material which passes through both the inner screen 15 and the outer screen 16 may be thrown outwardly in the direction of the arrow 43.

A roller shaped brush 45 is suspended by the rod 27 by means of arms 46 and 47 in such a way that the brush extends parallel with a generatrix for the outer screen 16. The arm 46 is secured to a bearing 48 which surrounds a rod 49 pivotably mounted on the rod 27 serving as counterweight, by means of two bearings 50 and 51. The lower arm 47 of the brush is secured to the rod 49 and, accordingly, it will be understood that the brush 45 may be pivoted about the longitudinal axis of the rod 49 and will rotate the rod during such movement due to the rigid connection between the lower arm 47 and the rod 49.

From the drawing it will be seen that the brush 45 is positioned at the side of the axis 31 of the main shaft, which faces away from the planet shaft 11. Accordingly, when the support structure is rotated by rotating the main shaft 5, a centrifugal force will be applied to the brush 45 in direction outwardly with respect to the drum 15, 16. In order to maintain contact between the brush 45 and the outer surface of the outer screen 16, a weight 54 is secured to the rod 49 by means of an arm 55 which is secured to the rod 49. The weight is adjustable in the longitudinal direction of the arm 55 in order to control the force with which the weight 54 will pivot the brush 45 about the axis of the rod 49 in order to achieve contact against the outer surface of the outer screen.

The lower end of the main shaft 5 extends down below the bottom frame 2 and carries a pulley 60 which is connected with a main drive motor (not shown) by means of V-belts 61 indicated in the drawing by means of dotted lines.

On the part of the main shaft 5 extending between the main bearing 4 and the bottom 7 a first set of gear-wheels is rotatably mounted comprising a lower comparatively large gear-wheel 63 and an upper comparatively small gear-wheel 64. By means of a chain 65 the gear-wheel 63 is connected with a drive motor (not shown) which is independent of the main motor.

The lower end of the rod 27 acting as a counterweight extends below the bottom 7 and carries another set of gear-wheels 66 having a lower comparatively large gear-wheel 67 connected by means of a chain 68 with the smaller gear-wheel 64 of the set 62. The set of wheels 66 also comprises a smaller gear-wheel 70 connected by means of a chain 71 with a gear-wheel 72 secured to the lower end of the planet shaft 11 which extends down below the bottom 7. The two runs of the chain 71 extend along each side of the main shaft 5.

As it appears from the drawing the greatest radius R of the drum, is longer than the eccentricity E of the planet shaft 11 with respect to the axis 31 of the main shaft 5. This means that the drum extends through the axis 31 of the main shaft.

The screening apparatus illustrated operates in the following way:

The material to be screened is fed through the inlet tube 30 and flows accordingly into the interior of the drum formed by the two screens 15 and 16. The drum is rotated by means of the corresponding motor via the sets of gear-wheels 62 and 66 and the gear-wheel 72. As will be understood from the beforegoing explanations, the drum performs a planetary movement and is simultaneously rotated about the axis of the planet shaft 11 and, accordingly, the material fed into the drum will be subjected to a centrifugal force action. This action will cause the material to be collected against the inner surface of the inner screen 15 and along a part of the inner screen which at any time is located at the longest distance from the main axis 31. Such material will form a body of material of kidney shaped cross section and the body will move downwardly along the inner surface of the inner screen and all the material having a grain size smaller than the openings in the inner screen 15 will be screened off. Such material will penetrate into the interspace between the inner screen 15 and the outer screen 16 and in this interspace the material in question will once more form a body of material having a kidney shaped cross section which will move downwardly along the inner surface of the outer screen 16 and, simultaneously, the fine material which may penetrate through the perforations in the outer screen 16 will be screened off. The cleaned material will remain in the interspace and will move downwardly out from the interspace and will via the inner surface of the baffle 14 and via a wear-resistant baffle 74 be conducted to the channel 35 from which the material will be dispensed by the vane means 34. The material which is too coarse to pass through the inner screen 15 will via the baffle 21 and the opening 22 be conducted to the channel 24 also guided by means of a wear-resistant baffle 75. In the channel 24 the coarse material will be caught by the vane means 23 and thrown out through the outlet 25. The fine material screened off will be conducted to the channel 41, caught by the vane means 40 and be guided out through the outlet 42.

Experiments have been made with an embodiment of the apparatus according to the invention wherein the main shaft 5 was driven at a speed of about 170 revolutions per minute and wherein the vane means 34 for dispensing the cleaned material were arranged along a circle having a diameter between 110 and 120 cm which results in a peripheral speed of the vane means of about 10 m/s which offers a good dispensing effect of the vane means 34 viz. in such a way that a suction through the apparatus simultaneously is achieved whereby air may be aspirated in the direction of the arrow 81 viz. through an interspace between the outer surface of the inlet tube 30 and an opening 82 in the top of the housing 1. Moreover, the apparatus used for the experiments was equipped with a screen drum wherein the diameter of the outer screen 16 varied between about 40 and 50 cm and was driven at an absolute speed of rotation at about 82 revolutions per minute. This results in a peripheral speed of the outer screen 16 of about 2 m/s which results in a good effect as regards the screening. It will be understood that the centrifugal force caused by the rotation of the drum about the axis 31 of the main shaft 5 will be superimposed by the centrifugal force caused by the rotation of the screen drum itself about the axis of the planet shaft 11. The optimum speeds referred to above of the vane means 34 and of the outer screen 16, respectively, have been produced without causing the resulting centrifugal force action upon the material being screened to be too high. Accordingly, it will be understood that if the excentricity E is greater than the maximum diameter R of the drum and it is required to keep the speeds referred to above, the resulting centrifugal force effect upon the material being screened will be considerably stronger than is the case when using an apparatus according to the present invention. Such reduced centrifugal force action upon the material results in that the kidney shaped cross section which the body of material has becomes comparatively large in the circumferential direction of the screening means 15 and 16, and simultaneously comparatively thin as seen in the radial direction. Hereby it is achieved that a comparatively large area (a broad stripe) of the inner surfaces of the two screens 15 and 16 becomes active and, accordingly, increases the capacity of the apparatus with respect to the conventional apparatus wherein the excentricity E is greater than the maximum radius R of the drum wherein the high resulting centrifugal force action causes the kidney shape to be more narrow and chubby whereby a narrow stripe only of the inner and outer screens will become active.

It will be understood that instead of two separate motors for driving the pulley 60 and the gear-wheel 63, respectively, a single drive motor may be used provided an appropriate gearing ratio is provided for between such motor and the pulley 60 and the gear-wheel 63, respectively. The reason why two separate drive motors have been mentioned previously is that two such motors were used during the experiments previously mentioned carried out for ascertaining the optimum operation conditions.

I claim:

1. Screening apparatus for grains, seeds or the like crops comprising a housing having a main axis and a planetary axis eccentrically located with respect to the main axis, said housing containing a support structure which is adapted to be rotated about the main axis and which supports screening means adapted to be rotated about the planetary axis, the support structure having vane means which, during the rotation of the support structure, move in a delivery channel for the screened goods which is formed in the housing, the eccentricity E of the planetary axis with respect to the main axis being smaller than the longest radius R of the screening means.

2. Screening apparatus according to claim 1, wherein the screening means comprises only one screen drum and a counterweight located on the support structure diagonally with respect to the screen drum.

3. Screening apparatus according to claim 1, wherein the counterweight consists of a rod arranged parallel with the planetary axis.

4. Screening apparatus according to claim 3, wherein the apparatus contains pivotably supported brush means which, when subjected to centrifugal forces, engages the outer surface of the screen drum, the brush means comprising at least one weight arranged eccentrically with respect to the pivot axis of the brush means.

5. Screening apparatus according to claim 1, wherein the support structure is supported by a main shaft on the main axis, the screening means is in the form of a screen drum supported by a planet shaft on the planetary axis, and further including means secured to the main shaft for driving the main shaft from a motor, a first set of gear-wheels comprising a larger and a smaller gear-wheel rotatably mounted on the main shaft, one of the gear-wheels of the first set being connected with a motor and the other being connected with a second set of gear-wheels comprising a larger and a smaller gear-wheel rotatably mounted on the support structure and being connected with a gear-wheel secured to the planet shaft.

6. Screening apparatus according to claim 5, wherein the second set of gear-wheels is located at the end of a rod constituting a counterweight arranged parallel with the planetary axis.

7. Screening apparatus according to claim 6, wherein the two runs of a chain which is located between the second set of gear-wheels and the planet shaft extend along each side of the main shaft.

8. Screening apparatus according to claim 1, wherein the vane means are positioned at such a distance from and are driven at such a number of revolutions that the speed of the vane means is about 10 m/s and that the diameter and the number of revolutions of the screening means are selected so as to provide a peripheral speed of the screening means of about 2 m/s.

9. Screening apparatus according to claim 5 wherein the means for driving the main shaft from a motor is a pulley.

10. Screening apparatus according to claim 5 wherein the means for driving the main shaft from a motor is a gear wheel.

* * * * *